United States Patent [19]

Kawakami et al.

[11] 4,317,115

[45] Feb. 23, 1982

[54] DRIVING DEVICE FOR MATRIX-TYPE DISPLAY PANEL USING GUEST-HOST TYPE PHASE TRANSITION LIQUID CRYSTAL

[75] Inventors: Hideaki Kawakami, Mito; Masaaki Kitajima, Hitachi; Naoyuki Izaki, Hitachi; Yoshiharu Nagae, Hitachi, all of Japan

[73] Assignee: Hitachi, Ltd., Tokyo, Japan

[21] Appl. No.: 98,666

[22] Filed: Nov. 29, 1979

[30] Foreign Application Priority Data

Dec. 4, 1978 [JP] Japan ..... 53-149153

[51] Int. Cl.[3] ..... G09G 3/36

[52] U.S. Cl. ..... 340/784; 340/805; 340/791; 350/346

[58] Field of Search ..... 340/784, 805, 811, 783, 340/791; 350/346

[56] References Cited

U.S. PATENT DOCUMENTS

| | | | |
|---|---|---|---|
| 4,100,540 | 7/1978 | Fujita et al. | 340/805 |
| 4,186,395 | 1/1980 | Fujita et al. | 340/805 |
| 4,200,822 | 4/1980 | Miller | 340/811 |
| 4,203,104 | 5/1980 | Kmetz | 340/805 |

*Primary Examiner*—Marshall M. Curtis

*Attorney, Agent, or Firm*—Craig and Antonelli

[57] ABSTRACT

A driving device for a matrix-type display panel using a guest-host type liquid crystal made by adding a pleochroic dye to a nematic-cholesteric phase transition liquid crystal or a chiralnematic phase transition liquid crystal is disclosed in which the display plane of a display panel is divided into a plurality of blocks in such a manner that each block includes a plurality of scanning lines, that is, a plurality of regions are formed, only one of the regions is selected to be used a scanning region, the one-line-at-a-time scanning operation is repeated many times in the scanning region in order to write and display information to perfection, and the regions are selected successively and cyclically to be used as the scanning region.

5 Claims, 14 Drawing Figures

DRIVING DEVICE FOR MATRIX-TYPE DISPLAY PANEL USING GUEST-HOST TYPE PHASE TRANSITION LIQUID CRYSTAL

BACKGROUND OF THE INVENTION

The present invention relates to a device for driving a guest-host type liquid crystal which is made by adding a pleochroic dye to a nematic-cholesteric phase transition liquid crystal or a chiralnematic phase transition liquid crystal, and more particularly to a driving device for a matrix-type display panel making use of a holding effect of the guest-host type liquid crystal.

Such phase transition liquid crystals as above exhibit a hysteresis phenomenon between the relative brightness thereof and the root mean square value of a voltage applied thereto. This hysteresis phenomenon is referred to as the holding effect, which is utilized as follows. Each liquid crystal cell is first applied with a holding voltage having a voltage value which is intermediate between the rising and falling voltages of a hysteresis loop, and a desired cell is then applied with a write-in voltage to be subjected to a phase transition. When the voltage applied to the desired cell is restored to the original holding voltage, the cell is maintained as it is. In other words, these liquid crystals, as is shown in FIG. 1 of the accompanying drawings, can assume at the holding voltage two stable states, in one of which the cell is put in the focalconic phase and scatters light, and in the other state, the cell is put in the nematic phase and becomes transparent. Therefore, it becomes possible by making use of the above hysteresis phenomenon to display a picture image, to increase a phase transition speed, and to prolong a memory time (holding time).

A conventional device for driving a matrix-type liquid crystal display panel, which makes use of the holding effect of the phase transition liquid crystals, is disclosed in an article entitled "Pulse-Length Modulation Achieves Two-Phase Writing in Matrix-Addressed Liquid Crystal Information Displays", by K. H. Walter and M. K. Taner, IEEE Transactions on Electron Devices, Vol. ED-25, No. 2, February 1978, pp. 172 to 174. In this method, a two-phase operation is employed, and each of the holding (sustaining), the write-in and the erasing voltages is formed through pulse-length modulation. In more detail, as is shown in FIG. 2, a voltage $V_H$ having a root mean square value $V_o\sqrt{1/N}$ (where $V_o$ indicates a peak value, and N the number of scanning lines) is used as the holding voltage. Further, in writing operation, a selected point is applied with a voltage $V_s$ having a root means square value $V_o\sqrt{2/N}$ to assume the focalconic phase, and a non-selected point is applied with $V_{NS}$ equal to OV to assume the nematic phase. Furthermore, a voltage $V_E$ having a high root mean square value $V_o\sqrt{(1-1/N)}$ is used to erase information. As is evident from the above, the ratio of the voltage $V_s$ applied to the selected point in the writing operation to the holding voltage $V_H$ ($V_S/V_H$) is equal to $\sqrt{2}$. Since the ratio $V_S/V_H$ is fixed as above, it is impossible to set the contrast of picture image to an optimal value by appropriately selecting the ratio $V_S/V_H$ in accordance with the characteristic of a liquid crystal cell used. Further, when the display panel becomes large-sized and the number of scanning lines is increased, the addressing time has to be reduced. In such a case, according to the above method, it is required to employ a high peak value $V_o$, and therefore it is impossible to drive the display panel by a low voltage circuit using a complementary MOS large scale integration (CMOSLSI).

Further, in a case where a large number of scanning lines are employed in a matrix-type liquid crystal display device, there appears the flicker on a display plane even when the display device is driven with a one-line-at-a-time scanning system, since the liquid crystal is generally slow in response speed. In order to prevent the above flicker, a rapid scanning mode for displaying a picture image has been employed in which the one-line-at-a-time scanning is repeatedly conducted to reduce the flicker by virtue of accumulative response effect. The rapid scanning mode is generally employed together with an amplitude selective multiplexing method, for the purpose of avoiding crosstalk, as is described in a U.S. Pat. No. 3,976,362. In this driving method, however, the number of scanning lines cannot exceed a limit, since the flicker is generated when the frame frequency of the one-line-at-a-time scanning is decreased to a value because of an increase in number of scanning lines, and since it is not possible to make the peak value of the voltage applied to the liquid crystal larger than a value for the purpose of enhancing the frame frequency.

SUMMARY OF THE INVENTION

An object of the present invention is to provide a driving device for a matrix-type display panel using a guest-host type phase transition liquid crystal which can increase the number of scanning lines without reducing the contrast ratio of displayed images.

According to the present invention which attains the above object, a matrix-type liquid crystal display panel including a guest-host type liquid crystal which is made by adding a pleochroic dye to a nematiccholesteric phase transition liquid crystal or a chiralnematic phase transition liquid crystal, is employed to make use of the holding effect of the guest-host type liquid crystal, and the display panel is divided into a holding region for holding a display state and a scanning region in which a display pattern is written, to drive these regions separately. Further, the holding region is applied with a holding voltage.

DESCRIPTION OF THE PREFERRED EMBODIMENTS

Figure 3:
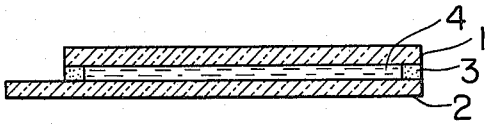
FIG. 3 is a sectional view for showing the construction of a matrix-type liquid crystal display panel to which the present invention is applied.
Figure 4:
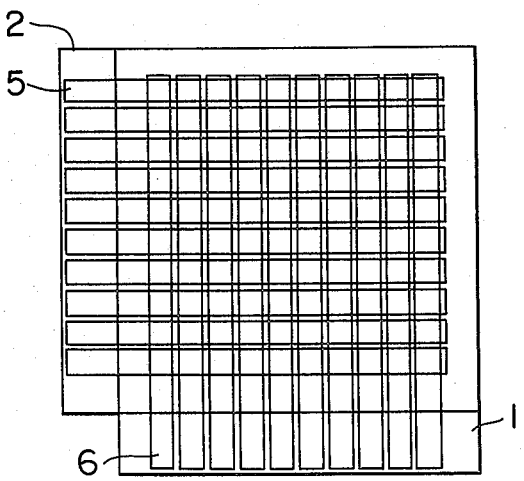
FIG. 4 is a plan view of the matrix-type liquid crystal display panel shown in FIG. 3.
Figure 5:
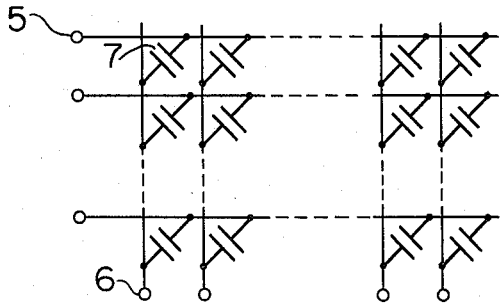
FIG. 5 shows an equivalent circuit of the matrix-type liquid crystal display panel shown in FIGS. 3 and 4.

Referring to FIGS. 3 and 4 which show a sectional view and a plan view of a matrix-type liquid crystal display panel, respectively two glass substrates 1 and 2 are superposed one upon the other with a spacer 3 interposed therebetween to provide a gap of about 10 μm. The gap is filled with a liquid crystal to form a liquid crystal layer 4. Further, the glass substrates 1 and 2 are provided on the facing surfaces thereof with the stripes of transparent electrodes 5 and the stripes of transparent electrodes 6, respectively, and are arranged in such a manner that the electrodes 5 intersect the electrodes 6 at right angles, to form a matrix structure. That is, a liquid crystal cell 7 is formed at each of intersecting points between the electrodes 5 and the electrodes 6, as is indicated by an equivalent circuit shown in FIG. 5. Such a matrix-type liquid crystal display panel is usually driven with the one-line-at-a-time scanning system.

The inventors studied the property of a guest-host type liquid crystal in which a pleochroic dye was added to a nematic-cholesteric phase transition liquid crystal or a chiralnematic phase transition liquid crystal, using the above-mentioned display panel, and found that the guest-host type liquid crystal exhibited a remarkable holding effect. In more detail, a chiral-nematic liquid crystal was made by adding an optically active material, for example, CB-15 having a constitutional formula

Figure 1:
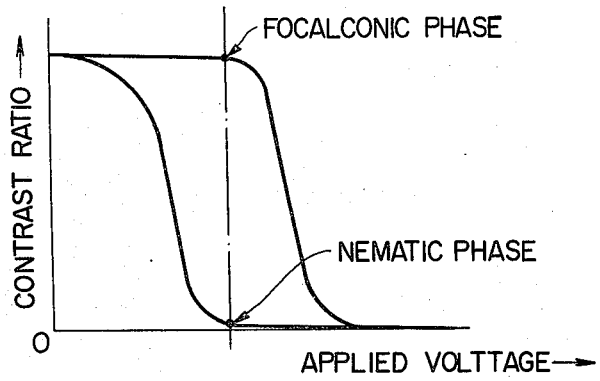
FIG. 1 PRIOR ART
FIG. 1 is a graph which shows a relation between the applied voltage and the contrast ratio, and is described in a prior publication.
Figure 2:
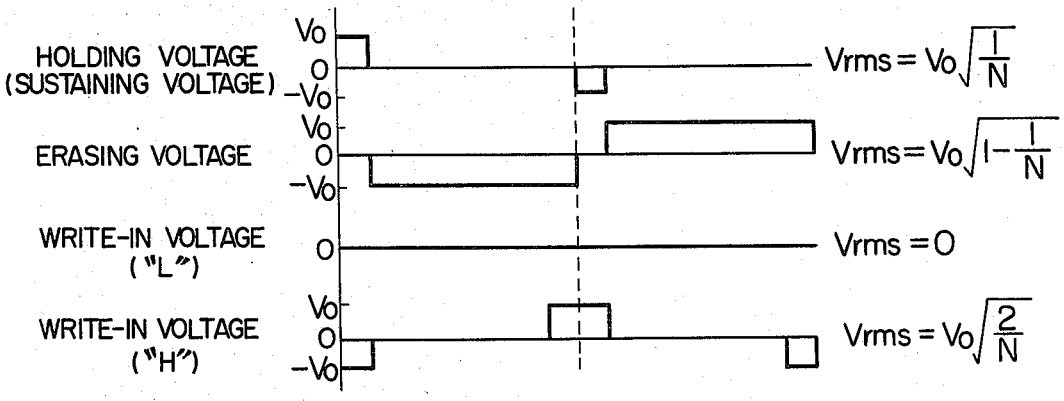
FIG. 2 PRIOR ART
FIG. 2 shows pulse waveforms for driving a matrix-type liquid crystal display panel which are disclosed in the prior publication.
Figure 6:
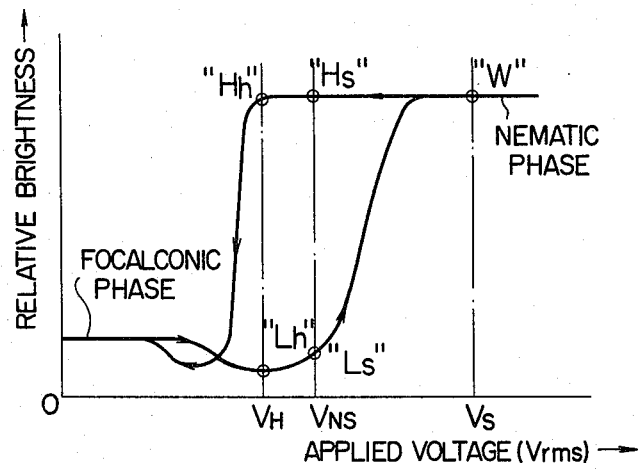
FIG. 6 is a graph showing a relation between the voltage applied to a liquid crystal used in the present invention and the relative brightness of the liquid crystal.

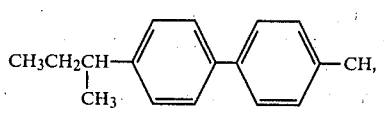

in a concentration of 2 to 5% by weight, to a nematic liquid crystal, for example, to ZLI-1132 (cyclohexane type) manufactured by the Merck Co. Further, a pleochroic cyanine dye NK-2233 (blue) was added in a concentration of 1% by weight to the above chiral-nematic liquid crystal to obtain a guest-host type liquid crystal. The electro-optical characteristic of the display panel containing the guest-host type liquid crystal was measured, and it was found that the relative brightness of the liquid crystal exhibited, as shown in FIG. 6, a hysteresis against the applied voltage. In other words, the relative brightness depends upon the root mean square value of applied voltage, and the locus of the relative brightness at the rising time of voltage is different from that at the falling time. Incidentally, FIG. 1 is a graph in a case where a dark character or pattern is displayed against a light background, and FIG. 6 is a graph in a case where a light character or pattern is displayed against a dark background. Therefore, the graph of FIG. 1 is reversed in form of characteristic curve as compared with that of FIG. 6.

In the driving methods making use of the characteristic shown in FIG. 6, the following operation is preferable since a low voltage drive can be conducted. The liquid crystal cells are first applied with a holding voltage $V_{NS}$, and are thereby brought in an initial state "$L_S$". When information is written in the liquid crystal layer, only selected points (or selected liquid crystal cells) are applied with a write-in voltage $V_S$, and are thereby put in a state "W" of high brightness. After the writing operation has been completed, the selected points are applied with the holding voltage $V_{NS}$ to be kept in a state indicated by "$H_S$". That is, a character or picture image is displayed by two states, namely, the state "$L_S$" of low brightness and the state "$H_S$" of high brightness.

Figure 7:
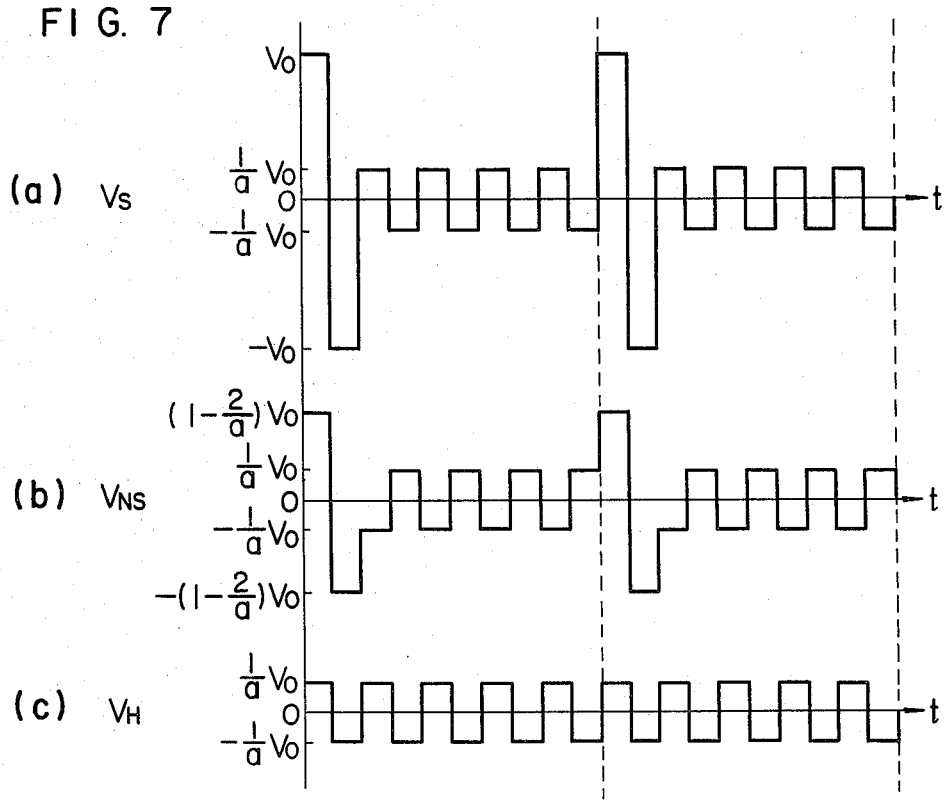
FIG. 7, including a-c, shows the waveforms of driving voltages applied to selected, half-selected and non-selected points of a matrix-type liquid crystal display panel.

In order to perform the above operation, the liquid crystal panel is driven in such an amplitude selective multiplexing method as mentioned below. FIG. 7 shows the waveforms of voltages applied to liquid crystal cells in a case where a liquid crystal panel having five scanning lines is scanned with the one-line-at-a-time scanning system and is driven in the amplitude selective multiplexing method. FIG. 7(a) shows the waveform of voltage applied to a selected liquid crystal cell, FIG. 7(*b*) the waveform of voltage applied to a half-selected point where only the row electrode is selected, and FIG. 7(*c*) the waveform of voltage applied to another half-selected point where only the column electrode is selected.

As mentioned above, FIG. 7 is concerned with a case that the panel includes five scanning lines. In order to treat a general case, however, let us assume that the panel includes N scanning lines. In this case, the root mean square value at one period of a waveform such as shown in FIG. 7(*a*), that is, a write-in voltage $V_S$ is given by the following equation:

$$V_S = \frac{1}{a} V_o \sqrt{1 + \frac{a^2 - 1}{N}} \quad (1)$$

where a indicates a bias ratio equal to or greater than 2. The root mean square value of a waveform applied to a half-selected point (where only the scanning line is selected), that is, a holding voltage $V_{NS}$ is given by the following equation:

$$V_{NS} = \frac{1}{a} V_o \sqrt{1 + \frac{(a-2)^2 - 1}{N}} \quad (2)$$

Further, the root mean square value of a waveform applied to another half-selected point (where only the column electrode is selected), that is, another holding voltage $V_H$ is expressed by the following relation:

$$V_H = \frac{1}{a} V_o \quad (3)$$

As can be seen from equations (1) and (2), the write-in voltage $V_S$ is greater than the holding voltage $V_{NS}$, and the ratio of $V_S$ to $V_{NS}$ is given by the following equation:

$$\frac{V_S}{V_{NS}} = \sqrt{\frac{N + a^2 - 1}{N + (a - 2)^2 - 1}} \quad (4)$$

When the bias ratio a is equal to $(\sqrt{N}+1)$, the above ratio assumes a maximum value given by the following equation:

$$\frac{V_S}{V_{NS}} = \sqrt{\frac{\sqrt{N} + 1}{\sqrt{N} - 1}} \quad (5)$$

As is evident from equation (5), the voltage ratio $V_S/V_{NS}$ is decreased and approximates to 1 (one), as the number of scanning lines is greater. In other words, the write-in voltage $V_S$ and the holding voltage $V_{NS}$ assume nearly the same value, and therefore the point W shown in FIG. 6 is brought close to the point $L_S$. As a result, the point W cannot be placed in a saturation region, and therefore the contrast of displayed images is lowered.

Figure 8:
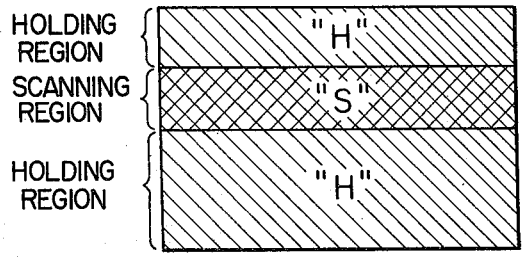
FIGS. 8 and 9 show how a display plane is divided into a plurality of regions in accordance with the present invention.

In order to solve the above problem, according to the present invention, a large-scale matrix-type liquid crystal display panel, as shown in FIG. 8, is divided into two kinds of regions, namely, the scanning region where the writing operation is presently being conducted and the holding region where the display state is maintained as it is. In more detail, only the scanning region is scanned with the one-line-at-a-time scanning system, and one or more holding regions are applied with a holding voltage to maintain a display state as it is. For example, when the scanning region is set so as to include nine scanning lines, the voltage ratio $V_S/V_{NS}$ equal to $\sqrt{2}$ is obtainable, as is known from equation (5), and therefore the display panel can exhibit a high contrast. After the write-in operation has been completed in one scanning region, one of the holding regions becomes the scanning region where the one-line-at-a-time scanning operation is repeatedly performed to write information in this region.

Figure 9:
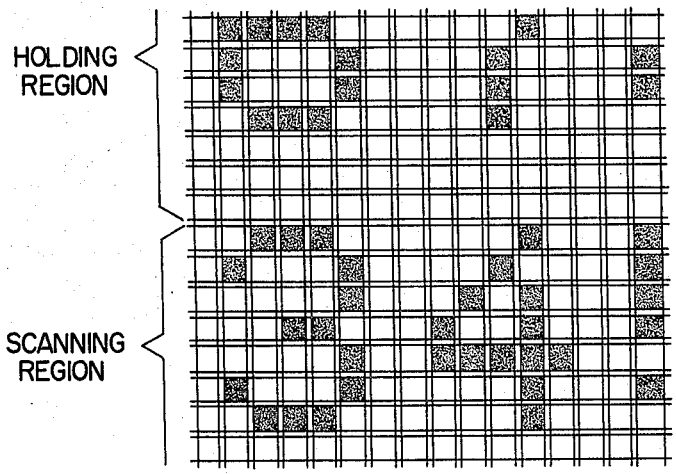
Figure 10:
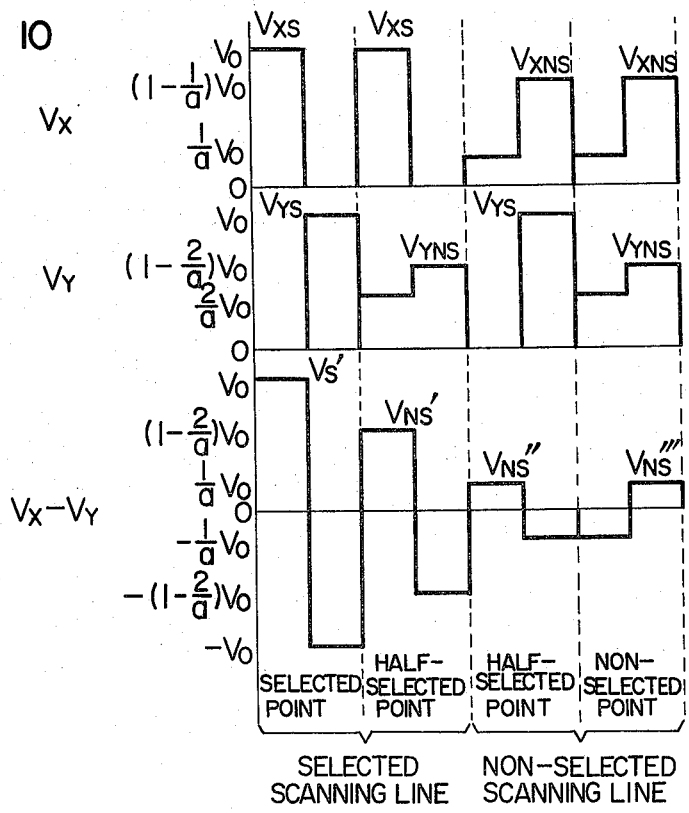
FIG. 10 shows the waveforms per cycle of voltages $V_X$, $V_Y$ and $V_X - V_Y$ which are applied respectively to row electrodes, column electrodes and liquid crystal cells of a matrix-type liquid crystal display panel in accordance with the present invention.

FIG. 9 shows, in part, the display plane of a display panel which is divided into a plurality of character rows each capable of including a series of characters arranged in the direction of scanning line. In this case, each of the character rows is used as the scanning region, and the rows are successively scanned to write characters in the whole display plane. That is, other character rows than that just scanned make up the holding region. FIG. 10 shows, in waveform per cycle, voltages for driving the above display panel in the amplitude selective multiplexing method, which voltages are applied to selected, half-selected and non-selected points. Referring to FIG. 10, a voltage $V_X$ applied to each row electrode (scanning electrode) assumes a waveform $V_{XS}$ when the electrode is selected and assumes a waveform $V_{XNS}$ when non-selected, and a voltage $V_Y$ applied to each column electrode assumes a waveform $V_{YS}$ or $V_{YNS}$ according as the electrode is selected or not. Accordingly, a voltage $V_X - V_Y$ applied to a liquid crystal cell assumes waveforms $V_S'$, $V_{NS}'$, $V_{NS}''$ and $V_{NS}'''$ for a selected cell, a half-selected cell on the selected scanning line (or a half-selected cell along the selected row electrode), a half-selected cell on the non-selected scanning line and a non-selected cell, respectively.

In a case where the scanning region includes five scanning lines, the waveform $V_S'$ is applied to the selected cell for only one fifth of the scanning period, as is known from FIG. 7(*a*). The selected cell is applied with the waveform $V_{NS}''$ for the remaining period to be put in the half-selected state. The half-selected cell in the scanning region which is not subjected to the write-in operation, is applied with the waveform $V_{NS}'$ for one fifth of the scanning period and with the waveform $V_{NS}'''$ for the remaining period, as is shown in FIG. 7(*b*). Further, in the holding region, the half-selected cell along the selected column electrode is continuously applied with the waveform $V_{NS}''$, as is shown in FIG. 7(*c*), and the non-selected cell is continuously applied with the waveform $V_{NS}'''$. As is apparent from the waveforms $V_{NS}''$ and $V_{NS}'''$ shown in FIG. 10, the voltage applied to the non-selected cell is reversed in polarity as compared with that applied to the half-selected cell along the selected column electrode.

As has been mentioned above, the half-selected cell in the scanning region which is not subjected to the write-in operation, is applied with the voltage having the waveform shown in FIG. 7(*b*). The root mean square value of the above voltage is equal to the holding voltage $V_{NS}$ given by equation (2). The half-selected and non-selected cells in the holding region are then applied respectively with the waveform shown in FIG. 7(*c*) and the inverted waveform thereof. The root mean square values of these waveforms are both equal to the holding voltage $V_H$ given by equation (3). As is apparent from the comparison between equations (2) and (3), the holding voltage $V_{NS}$ is greater than the holding voltage $V_H$. That is, two holding voltages are employed, as is shown in FIG. 6.

Since the holding voltage $V_{NS}$ is applied to the half-selected cell in the scanning region, the phase transition speed of the liquid crystal used becomes high as the difference between the holding voltage $V_{NS}$ and the write-in voltage $V_S$ is smaller. On the other hand, in this case, the relative brightness of a liquid crystal cell at a time when the holding voltage $V_{NS}$ is applied, is not always coincident with that at a time when the holding voltage $V_H$ is applied. Accordingly, the whole display plane becomes irregular in brightness, so that a flicker is generated on the display plane. The above problem can be solved in the following manner. As mentioned previously, the liquid crystal cells in the holding retion are always applied with the holding voltage $V_H$. Accordingly, if the waveform $V_{NS}'$ shown in FIG. 10 is applied to all the cells in the holding region every time the scanning region is scanned, the voltage applied to the cells in the holding region becomes equal to the voltage $V_{NS}$, which is applied to the half-selected cell in the scanning region. That is, all of the liquid crystal cells of the display panel other than selected cells are applied with the same holding voltage $V_{NS}$. Thus, the above-mentioned irregularity in brightness or the flicker may be prevented.

Further, when information written in the liquid crystal layer is erased, the applied voltage is temporarily made equal to zero to translate all the liquid crystal cells from the state of "$H_S$" or "$H_h$" to the state of "$L_S$" or "$L_h$".

Next, explanation will be made on a driving circuit for a matrix-type liquid crystal display panel.

Figure 11:
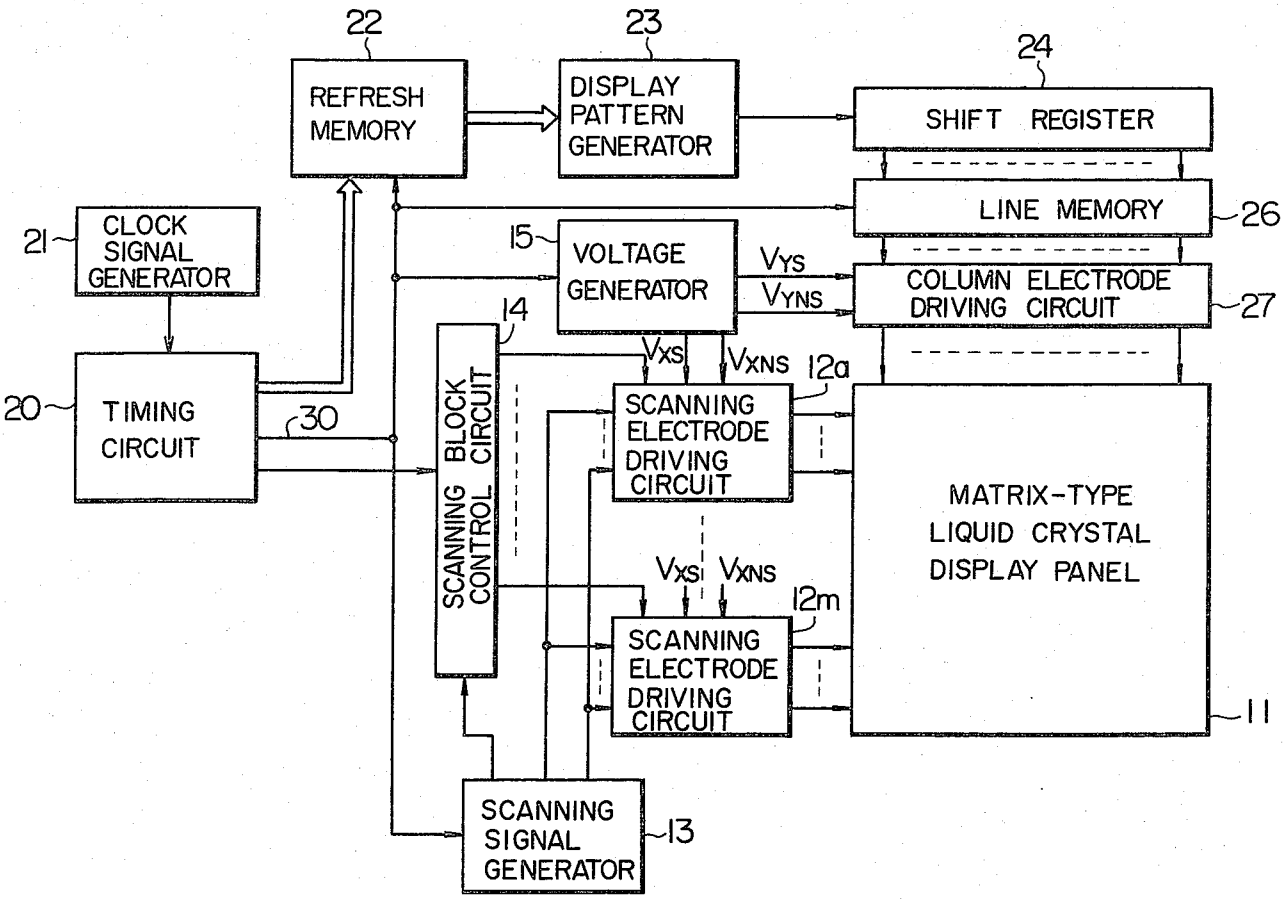
FIG. 11 is a block diagram showing an embodiment of a driving device according to the present invention.

Referring to FIG. 11, a matrix-type liquid crystal display panel 11 includes row electrodes, column electrodes and a liquid crystal layer sandwiched therebetween. The row electrodes and the column electrodes are arranged so as to form a matrix structure. The display plane of the panel 11 is divided into a plurality of display regions (or scanning blocks) each including a plurality of scanning electrodes (or row electrodes). Scanning electrode driving circuits 12*a* to 12*n* are provided in correspondence to the display regions, and each of the circuits 12*a* to 12*n* drives the scanning electrodes included in a corresponding display region. Scanning signals are supplied in parallel from a scanning signal generator 13 to each of the scanning electrode driving circuits 12*a* to 12*n* through signal lines, the number of which is equal to the number of scanning electrodes included in one display region. The signal lines are successively applied with a high-level signal to cause each of the driving circuit 12*a* to 12*n* to perform the one-line-at-a-time scanning operation. A scanning block control circuit 14 selects one of the scanning electrode driving circuits 12*a* to 12*n* which is to be scanned, and then selects a next scanning electrode driving circuit when the scanning operation in the preceding driving circuit has been completed, in order to perform the scanning operation in the next scanning electrode driving circuit. Such an operation of the scanning block control circuit 14 is repeated to perform the scanning operation in all of the scanning electrode driving circuits 12*a* to 12*n*. The above selection is made by applying a high-level signal to a signal line which is connected to a scanning electrode driving circuit to be scanned. A voltage generator 15 generates the voltages having the waveforms $V_{XS}$, $V_{XNS}$, $V_{YS}$ and $V_{YNS}$ shown in FIG. 10.

Figure 12:
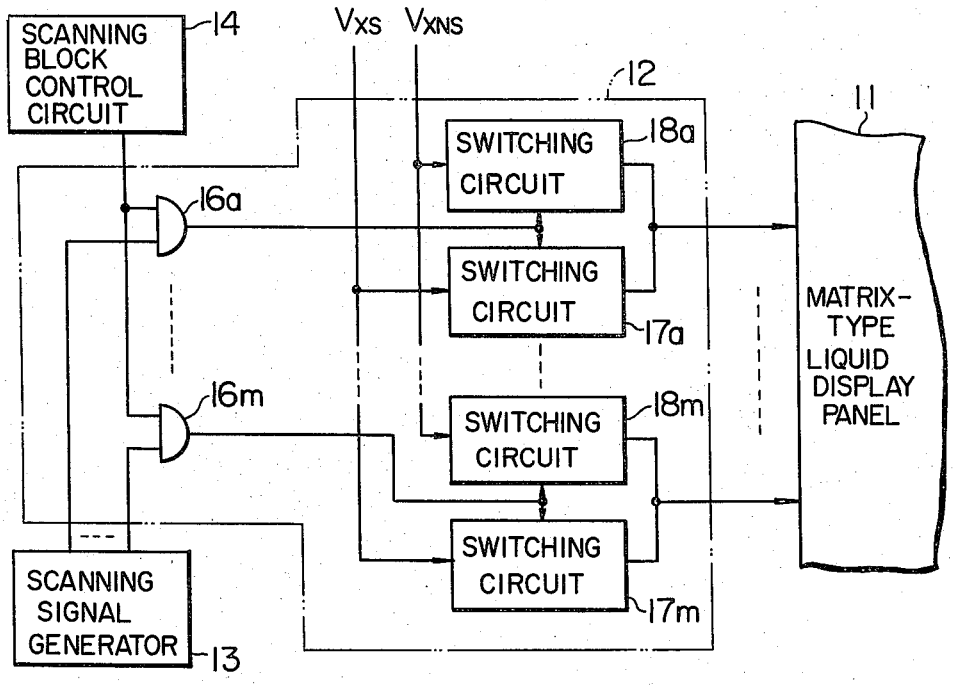
FIG. 12 shows a detailed circuit configuration of an example of the scanning electrode driving circuit shown in FIG. 11.

Each of the scanning electrode driving circuits 12*a* to 12*n* is supplied with the selection voltage (or voltage waveform) $V_{XS}$ and the non-selection voltage (or voltage waveform) $V_{XNS}$ from the voltage generator 15, and is further supplied with the scanning signals from the scanning signal generator 13 when applied with the high-level signal from the scanning block control circuit 14. When the scanning electrode driving circuit is applied with the low-level signal from the scanning block control circuit 14, the scanning signal, which is supplied from the scanning signal generator 13 to the scanning electrode driving circuit, is blocked, that is, put in the low level. This operation can be conducted by providing AND gates 16*a* to 16*m*, which are controlled by a signal from the scanning block control circuit 14, respectively on m signal lines for connecting the scanning signal generator 13 to one of the scanning electrode driving circuits, as is shown in FIG. 12. Referring to FIG. 12, the voltages $V_{XS}$ and $V_{XNS}$ are applied to the scanning electrodes through switching circuits 17*a* to 17*m* and switching circuits 18*a* to 18*m*. The number of AND gates 16*a* to 16*m*, that of switching circuits 17*a* to 17*m* and that of switching circuits 18*a* to 18*m* are all equal to the number of scanning electrodes included in one display region (or scanning block). The switching circuits 17*a* to 17*m* and 18*a* to 18*m* are controlled by the output signals of the AND gates 16*a* to 16*m* in the following manner. That is, when a pair of switching circuits for example, the switching circuits 17*a* and 18*a* are applied with a high-level signal from a corresponding AND gate, namely, the AND gate 16*a*, the switching circuits 17*a* and 18*a* are operated so as to apply the voltage $V_{XS}$ to a corresponding scanning electrode. While, when applied with a low-level signal from the AND gate 16*a*, the switching circuits 17*a* and 18*a* are operated so as to apply the voltage $V_{XNS}$ to the corresponding scanning electrode.

A timing circuit 20 includes therein a plurality of cascade-connected frequency dividers, which successively divide the frequency of a pulse train from a clock signal generator 21 to send out desired timing signals. Since the frequency dividers have the same structure as the counters, the address of a refresh memory 22 can be formed by the contents of a frequency devider. The refresh memory 22 stores therein information, which is to be displayed on the display plane, in the form of code. The stored information is read out in accordance with an address signal from the timing circuit 20, and is then sent as display information to a display pattern generator 23. The display pattern generator 23 generates a video signal on the basis of the display information to send the video signal to a shift register 24. The shift register 24 effects the series-parallel conversion for the video signal in accordance with an instruction from the timing circuit 20. The converted video signal is sent to a line memory 26 through signal lines, which correspond to the column electrodes of the display panel 11. Since the relation in operation among the refresh memory 22, display pattern generator 23 and shift register 24 is well known, the detail explanation thereof is omitted for the sake of simplicity. A column electrode driving circuit 27 has the same circuit construction as that part of the circuit shown in FIG. 12 which includes the switching circuits 17*a* to 17*m* and the switching circuits 18*a* to 18*m*. Accordingly, the selection voltage $V_{YS}$ is applied to a column electrode correspoiding to the output line of the line memory 26 applied with a high-level signal, and the non-selection voltage $V_{YNS}$ is applied to a column electrode corresponding to the output line applied with a low-level signal.

The timing circuit 20 delivers on an output line 30 a control pulse which is synchronized with a time at which a scanning electrode is selected. The control pulse may have the duty of 50%. The scanning signal generator 13 successively delivers the scanning signal on the output lines thereof in synchronism with the control pulse. The voltage generator 15 delivers the selection voltage $V_{XS}$ and $V_{YS}$ and the non-selection voltages $V_{XNS}$ and $V_{YNS}$ in synchronism with the control pulse. The refresh memory 22 sends out information in synchronism with the control pulse. Further, the line memory 26 takes in the video signal in synchronism with the control pulse. The scanning block control circuit 14 is controlled by another pulse from the timing circuit 20.

Figure 13:
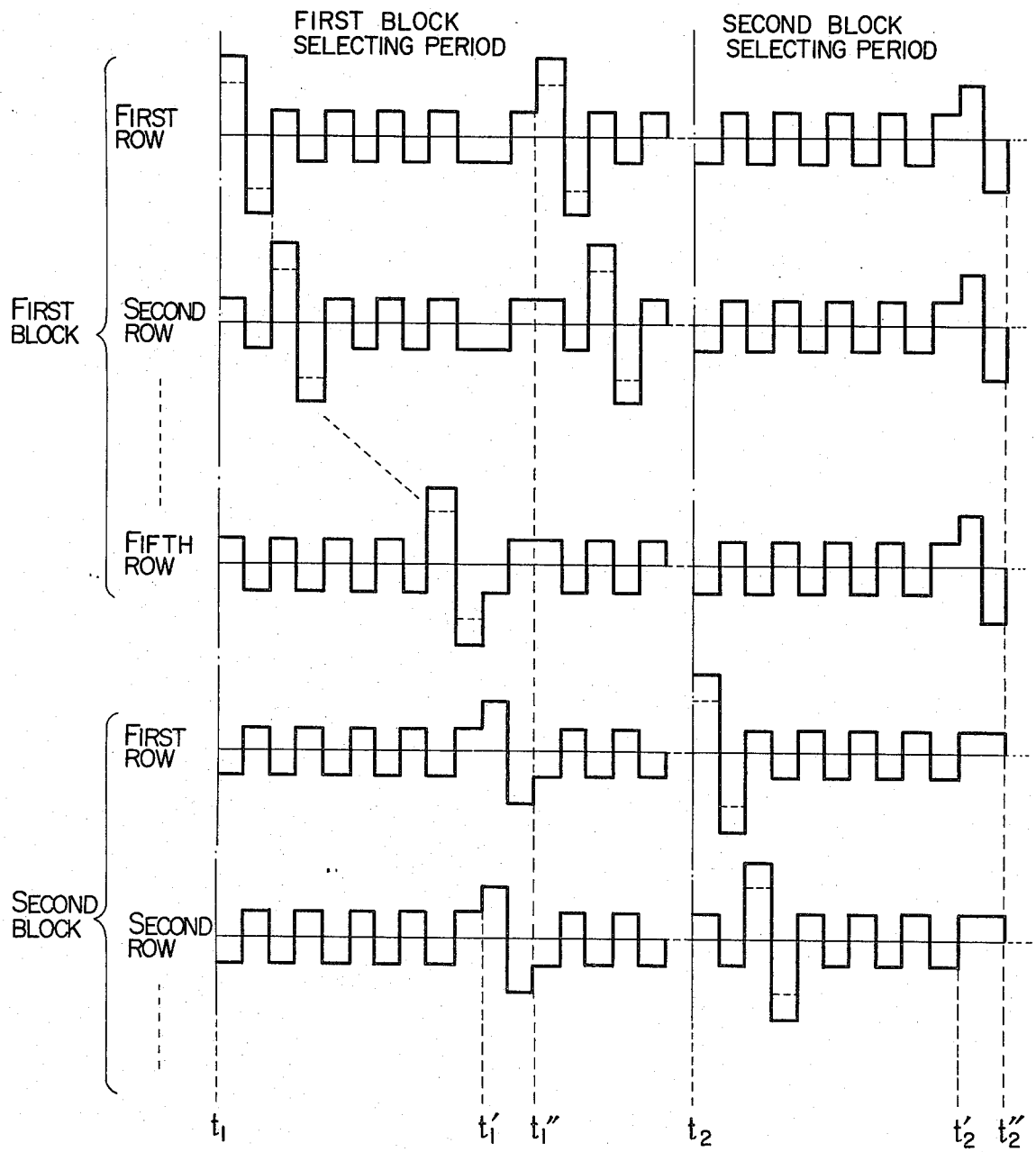
FIG. 13 shows voltage waveforms applied to liquid crystal cells in accordance with the present invention.

FIG. 13 shows the waveforms of voltages applied to liquid crystal cells by the above-mentioned circuit arrangement, in a case where each of the scanning electrode driving circuits 12*a* to 12*n* drives five row electrodes. Now, let us consider a case when the scanning block control circuit 14 selects the scanning electrode driving circuit 12*a*. The driving circuit 12*a* scans first, second, third, fourth and fifth scanning electrodes in the one-line-at-a-time scanning method. These five electrodes are successively applied with the selection voltage in one scanning period. Thus, liquid crystal cells which are sandwiched between the first, second, third, fourth and fifth scanning electrodes and a selected column electrode, are applied with the voltage waveforms indicated by solid lines in FIG. 13. On the other hand, liquid crystal cells which are sandwiched between the above scanning electrodes and a non-selected column electrode, are applied with the voltage waveforms indicated by broken lines in FIG. 13. The one-line-at-a-time scanning operation is performed once in a period from $t_1$ to $t_1''$, and a second scanning electrode driving circuit 12*b* is selected at a time $t_2$.

Figure 14:
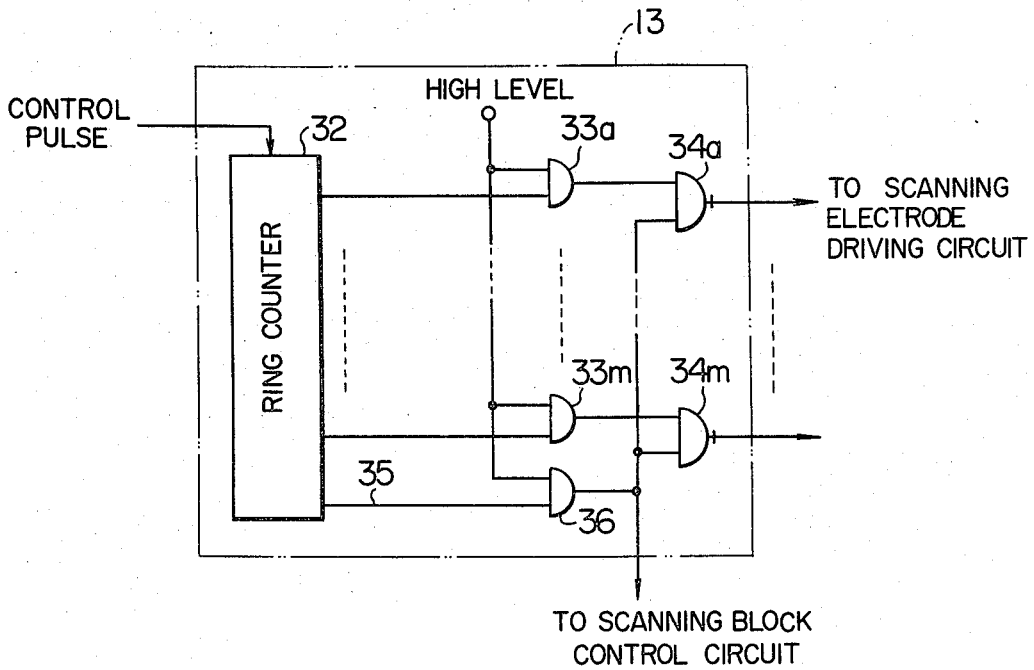
FIG. 14 is a circuit diagram showing an example of the scanning signal generator shown in FIG. 11.

According to an embodiment of the present invention, the row electrodes, and column electrodes, which are concerned with all the liquid crystal cells contained in the holding region, are applied respectively with the selection voltage and the non-selection voltage once in one period of one-line-at-a-time scanning operation, in order to avoid irregularity of brightness or flicker on the display plane. As shown in FIG. 13, this is done in the last cycle of each one-line-at-a-time scanning period, for example, at time intervals from $t_1'$ to $t_1''$ and from $t_2'$ to $t_2''$. In more detail, at these time intervals, the outputs of the scanning block control circuit 14 are inverted in polarity to apply a low-level signal to a selected scanning electrode driving circuit and to apply a high-level signal to each of the remaining scanning electrode driving circuits, and all the output lines of the scanning signal generator 13 are applied with high-level signals. FIG. 14 shows a circuit arrangement of the scanning signal generator 13 which can effect the above operation. Referring to FIG. 13, the output lines of a ring counter 32 are successively put in the state of "HIGH" in response to the control pulse. As a result, the output lines of the scanning signal generator 13 are successively applied with a high-level signal through AND gates 33*a* to 33*m* and OR gates 34*a* to 34*m*. However, when an output line 35 of the ring counter 32 is put in the state "HIGH", all the output lines of the scanning signal generator 13 are simultaneously applied with the high-level signal through an AND gate 36 and the OR gates 34*a* to 34*m*. The high-level signal from the AND gate 36 is also applied to the scanning block control circuit 14 to invert the polarity of every output thereof. Since a circuit for effecting the above inversion of polarity is well known, a circuit diagram thereof is omitted for brevity's sake.

We claim:

1. A driving device for a matrix-type display panel using a guest-host type phase transition liquid crystal comprising:

a matrix-type display panel including a guest-host type liquid crystal, said guest-host type crystal being made by adding a pleochroic dye to either one of a nematic-cholesteric phase transition liquid crystal and a chiralnematic phase transition liquid crystal;

a scanning region selecting circuit for selecting a scanning region on a display plane of said matrix-type display panel, said selected scanning region including a predetermined number of scanning lines, and being scanned to write information therein, said scanning region selecting circuit selecting a next scanning region when the scanning operation in said selected scanning region has been completed, so that said scanning region selecting circuit divides said matrix into said scanning region in which new information can be written and at least one holding region wherein new information cannot be written;

a scanning circuit for repeatedly scanning said scanning lines of said selected scanning region in a one-line-at-a-time scanning fashion, said scanning operation being repeated a plurality of times to write and display said information in full degree;

a scanning line voltage applying circuit for applying a desired selection voltage and a non-selection voltage respectively to a selected scanning line and all other scanning lines than said selected scanning lines, in synchronism with said one-line-at-a-time scanning operation performed by said scanning circuit;

a column voltage applying circuit for applying another selection voltage and another non-selection voltage respectively to one or more column electrodes and the remaining column electrodes in synchronism with said one-line-at-a-time scanning operation performed by said scanning circuit, said one or more column electrodes corresponding to one or more selected positions on said selected scanning line, all of said column electrodes being arranged perpendicular to said scanning lines; and a voltage generator for supplying said scanning line voltage applying circuit with said selection and non-selection voltages and for supplying said column voltage applying circuit with said another selection and non-selection voltages, wherein said respective selection and non-selection voltages applied to said scanning region serve to provide write-in signals for writing in new information to said scanning region, and wherein said respective selection and non-selection voltages applied to said holding region serve as holding signals to said holding region to maintain the display state of said holding region as it is.

2. A driving device for a matrix-type display panel using a guest-host type phase transition liquid crystal according to claim 1, wherein said scanning region selecting circuit includes a plurality of scanning line driving circuit corresponding to a plurality of divided regions of said display plane and a scanning block selecting circuit for selecting another scanning line driving circuit every time said scanning operation for writing information has been completed in one scanning line driving circuit and for effecting said selecting operation successively and repeatedly.

3. A driving device for a matrix-type display panel using a guest-host type phase transition liquid crystal according to claim 1 or 2, wherein said selection and non-selection voltages applied to said scanning lines and said another selection and non-selection voltages applied to said column electrodes have such waveforms as to apply a holding voltage $$\frac{1}{a} V_o \sqrt{1 + \frac{(a-2)^2 - 1}{N}}$$

to those liquid crystal cells in said scanning region which are to be applied with a holding voltage, and to apply another holding voltage $(1/a)V_o$ to all liquid crystal cells in other regions than said scanning region, where $V_o$, N and a indicate a peak value of voltage applied to selected liquid crystal cell, the number of scanning lines included in a scanning region, and a bias ratio, respectively.

4. A driving device for a matrix-type display panel using a guest-host type phase transition liquid crystal according to claim 3, wherein, at a time interval in one period of said one-line-at-a-time scanning operation conducted by said scanning circuit, said scanning line voltage applying circuit applies said selection voltage to each of scanning lines in other regions than said scanning region, and said column voltage applying circuit applies said another non-selection voltage to each of said column electrodes.

5. A driving device for a matrix-type display panel according to claim 2, wherein said scanning region selecting circuit includes gate means coupled between said scanning circuit and said scanning line driving circuits, said gate means being controlled by said scanning block selecting circuit to only passing a scanning signal from said scanning circuit to a selected scanning line driving circuit.

* * * * *